US007750567B2

(12) United States Patent
Ahn

(10) Patent No.: US 7,750,567 B2
(45) Date of Patent: Jul. 6, 2010

(54) PLASMA DISPLAY DEVICE WITH INCREASED LUMINANCE AND DECREASED JITTER

(75) Inventor: Sung Yong Ahn, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 656 days.

(21) Appl. No.: 11/609,303

(22) Filed: Dec. 11, 2006

(65) Prior Publication Data

US 2007/0132388 A1 Jun. 14, 2007

(30) Foreign Application Priority Data

Dec. 12, 2005 (KR) ..... 10-2005-0121823

(51) Int. Cl.
*H01J 17/49* (2006.01)

(52) U.S. Cl. ..... 313/583; 313/582; 313/584; 313/585; 313/586; 315/169.4

(58) Field of Classification Search ..... 313/582–587; 315/169.1, 169.4; 345/37, 41, 60, 71
See application file for complete search history.

(56) References Cited

U.S. PATENT DOCUMENTS 6,023,130 A * 2/2000 Sakasegawa et al. ..... 313/582
6,650,063 B2 * 11/2003 Uemura et al. ..... 315/169.4
6,657,387 B1 * 12/2003 Yoo ..... 313/587
6,683,589 B2 * 1/2004 Sano et al. ..... 345/60
7,157,842 B2 * 1/2007 Yao ..... 313/292
7,452,485 B2 * 11/2008 Hoshino et al. ..... 252/301.6 F
7,453,208 B2 * 11/2008 Lin et al. ..... 313/582
2002/0042025 A1 * 4/2002 Tokai et al. ..... 430/321
2004/0160187 A1 * 8/2004 Yao ..... 313/609
2004/0178730 A1 * 9/2004 Shinoda et al. ..... 313/582
2005/0067958 A1 * 3/2005 Woo et al. ..... 313/582
2005/0077821 A1 * 4/2005 Jeon ..... 313/582
2005/0162083 A1 * 7/2005 Lee et al. ..... 313/582
2005/0242728 A1 * 11/2005 Song et al. ..... 313/583
2006/0125398 A1 * 6/2006 Ahn ..... 313/583

OTHER PUBLICATIONS

European Search Report dated Nov. 19, 2009, for Application No. 06025724.3, 11 pages.

(Continued)

*Primary Examiner*—Sikha Roy
*Assistant Examiner*—Jose M Diaz
(74) *Attorney, Agent, or Firm*—Fish & Richardson P.C.

(57) ABSTRACT

The present invention presents top/bottom widths of the first and second barrier rib of the plasma display device. The first barrier rib fulfills a condition of 0<the bottom width−the top width<80 μm or/and the second barrier rib fulfills a condition of 0<the bottom width−the top width<50 μm. Furthermore, at least one of a first condition of 0.63<a value where the first length of a region of the rear substrate other than a region in which the barrier ribs are formed in a discharge space within the discharge cell and a region in which the scan electrode is overlapped is divided by the first pitch of the discharge cell<1, a second condition of 0.24<a value where the second length of the region is divided by the second pitch of the discharge cell<1, and a third condition of 0.15<a value where an area of the region is divided by an area of the discharge cell<1 is fulfilled.

21 Claims, 12 Drawing Sheets

OTHER PUBLICATIONS

Kim H. C. et al; "Three-Dimensional Fluid Simulation of a Plasma Display Panel Cell"; Journal of Applied Physics, American Institute of Physics, vol. 91, No. 12; Jun. 15, 2002, pp. 9513-9520; XP012055458, ISSN.

Punset C. et al; "Two-Dimensional Simulation of An Alternating Current Matrix Plasma Display Cell: Cross-Talk and Other Geometric Effects"; Journal of Applied Physics, American, Institute of Physics, vol. 83, No. 4; Feb. 15, 1998, pp. 1884-1897, XP012044657 ISSN.

Han S. et al.; "Global Description of the Micro-Discharge System in Connection with the Plasma Display Panel"; The Japan Society of Applied Physics; vol. 41, Part 1, No. 7A, Jul. 2002, pp. 4696-4699, XP007910452.

Uhm Han S. et al; "Influence of Secondary Electron Emission on Breakdown Voltage In A Plasma Display Panel"; Applied Physics Letters, American Institute of Physics, vol. 78, No. 5, Jan. 29, 2001, pp. 592-594, XP012028500 ISSN.

* cited by examiner

PLASMA DISPLAY DEVICE WITH INCREASED LUMINANCE AND DECREASED JITTER

This Nonprovisional application claims priority under 35 U.S.C. §119(a) on Patent Application No. 10-2005-0121823 filed in Korea on Dec. 12, 2005, the entire contents of which are hereby incorporated by reference.

BACKGROUND

1. Field of the Invention

The present invention relates to a plasma display device and, more particularly, to a discharge cell capable of increasing luminance while decreasing jitter, and a barrier rib structure provided in the discharge cell.

2. Discussion of Related Art

A plasma display panel is an image display device in which discharge cells are formed between a rear substrate having barrier ribs formed thereon and a front substrate opposite to the rear substrate. The plasma display panel implements an image by exciting phosphors with Vacuum UltraViolet (VUV) rays generated when an inert gas within each discharge cell is discharged by a high frequency voltage.

In general, the plasma display panel is adapted to implement an image by employing red (R), green (G) and blue (B) visible rays, which are generated when VUV radiated from plasma obtained through a gas discharge excites phosphors.

The plasma display device is adapted to implement an image as a surface discharge or an opposite discharge is generated from the inside of a discharge cell by means of driving voltages applied to scan electrodes, sustain electrodes and address electrodes. In order to improve luminance and emission efficiency, a long gap arrangement method in which scan electrodes Y and sustain electrodes Z are spaced apart from each other at a predetermined distance so as to secure the aperture ratio is employed.

In the case where barrier ribs are formed in a close form in the discharge cells in which the scan electrodes Y and the sustain electrodes Z are disposed in the long gap fashion, an address discharge generated in an opposite discharge form between the scan electrodes Y and the address electrodes X becomes difficult. Accordingly, address discharge delay, that is, jitter is increased. There are also problems in that an address discharge firing voltage and a sustain discharge firing voltage are increased.

This is because, in the case of discharge cells in which the first barrier ribs and the second barrier ribs are closed, the barrier ribs having a bottom width wider than a top width close the four sides, making it difficult to sufficiently secure discharge space.

SUMMARY OF THE INVENTION

Accordingly, the present invention is to solve at least the problems and disadvantages of the background art.

A plasma display device according to an embodiment of the present invention includes a discharge cell having a scan electrode and a sustain electrode formed on a front substrate, and an address electrode formed on a rear substrate, the discharge cell being separated from neighboring discharge cells by means of the first barrier rib or/and the second barrier rib. A distance between the scan electrode and the sustain electrode is set in the range of 90 to 200 μm, the first barrier rib has a bottom width wider than a top width, and a difference between the bottom width and the top width of the first barrier rib is set in the range of 80 μm or less. The second barrier rib fulfills a condition of 0<the bottom width −the top width<50 μm or/and 1<the bottom width/the top width<1.8.

In this case, a distance of 90 μm or more refers to one of a distance between the transparent electrodes and a distance between the metal electrodes, which is closer than the other.

Assuming that a region in which the scan electrode and the rear substrate are overlapped in a discharge space within the discharge cell is a valid overlap area, the range of 0.15<the valid overlap area/a discharge cell area<1 is fulfilled. Furthermore, the valid overlap area is 0.63<the width of the valid overlap area/the first pitch of the discharge cell<1, and 0.24<the length of the valid overlap area/the second pitch of the discharge cell<1.

DETAILED DESCRIPTION OF THE INVENTION

The present invention relates to a plasma display device, and a discharge cell structure, which can decrease jitter and lower discharge voltages while improving luminance.

More particularly, the present invention presents a variety of barrier rib structures in a discharge cell having scan electrodes and sustain electrodes arranged in a long gap form, and also a distance range of the scan electrodes and the sustain electrodes in a discharge cell having a close type barrier rib structure.

Other objects and advantages of the present invention will become more apparent from the following detailed description taken in conjunction with the annexed drawings, which disclose embodiments of the invention.

The present invention will now be described in detail in connection with specific embodiments with reference to FIGS. 1 to 17.

Figure 1:
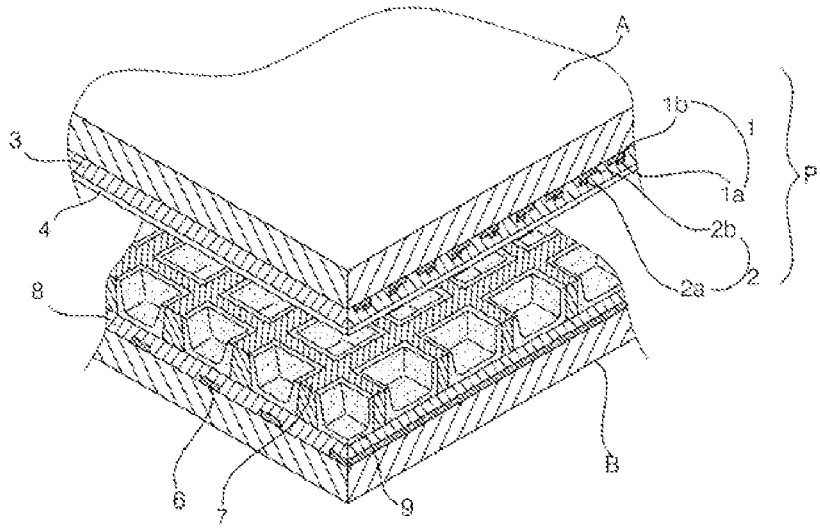
FIG. 1 is a perspective view of a discharge cell of a plasma display panel.

FIG. 1 is a view illustrating the construction of a panel P according to an embodiment of the present invention. The panel P includes a front substrate A and a rear substrate B coalesced together with a gap therebetween.

Scan electrodes 1 and sustain electrodes 2 are formed on the front substrate A. Address electrodes 6 are formed on the rear substrate B. The scan electrodes 1 and the sustain electrodes 2 cross the address electrodes 6 within cells.

Each of the scan electrodes 1 includes a transparent electrode 1*b* and a bus electrode 1*a*. Each of the sustain electrodes 2 includes transparent electrode 2*b* and a bus electrode 2*a*. The transparent electrodes are formed from tin oxide and zinc oxide called Indium Tin Oxide (ITO), and generate a plasma discharge and cause light, generated within the cells, to be discharged to the outside.

In order to lower sheet resistance of the transparent electrodes, the bus electrodes 1*a* and 2*a*, which are overlapped with the transparent electrodes within a range of 0.4 to 0.5 times a width of the transparent electrode is provided.

A dielectric layer 3 is formed on the scan electrodes 1 and the sustain electrodes 2. A protection layer 4 for protecting the dielectric layer 3 may also be formed on the dielectric layer 3.

A dielectric layer 8 is also formed on the address electrodes 6. Barrier ribs 7 partitioning the discharge cells in the first/the second directions, and R, G and B phosphors 9 coated on the dielectric layer 8 and the barrier ribs 7 are formed on the dielectric layer 8.

It is to be noted that the construction of the plasma display panel according to an embodiment of the present invention is not limited to the construction of FIG. 1.

For example, the scan electrode 1 and the sustain electrode 2 can have an ITO-less structure including only the bus electrodes l*a* and 2*a* without the transparent electrodes 1*b* and 2*b* made of ITO. The scan electrode 1 and the sustain electrode 2 can have an integral type Black Matrix (BM) structure in which a BM is integrally formed in the front substrate A, though not shown in the drawing.

Further, the scan electrode 1 and the sustain electrode 2 may include two or more electrode lines, and may also include other electrodes.

The plasma display panel is driven with one frame being divided into several subfields having a different number of emissions in order to implement gray levels of an image. Each subfield is divided into a reset period in which the whole screen is reset, an address period in which a scan line is selected and a cell is selected from a selected scan line, and a sustain period in which gray levels are implemented according to a discharge number.

Figure 2:
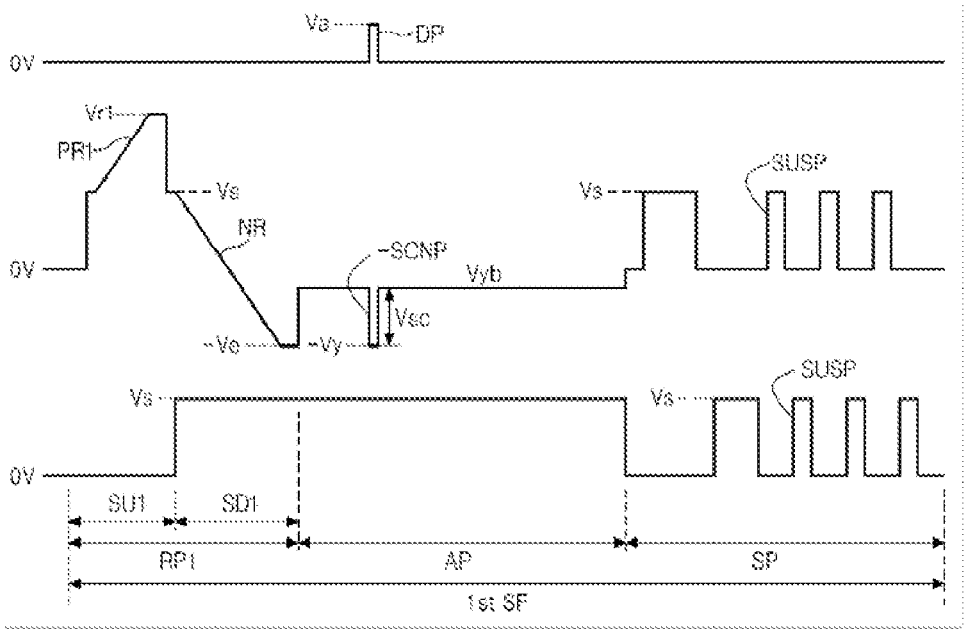
FIG. 2 shows a waveform illustrating time-divided driving of the plasma display panel.

A driving waveform applied during a first subfield is described below with reference to FIG. 2. The driving waveform is divided into a reset period RP1, an address period AP and a sustain period SP. The reset period comprises a setup period SU1 in which a voltage level of the scan electrode rises, and a setdown period SD1 in which a voltage level of the scan electrode falls.

In the setup period SU1 of the reset period RP1, a setup signal PRI that gradually rises up to a reset voltage Vr1 is applied to the entire scan electrodes Y. Further, in this period, wall charges are slowly accumulated within the cells while a setup discharge is generated by the setup signal PR1.

In the setdown period SD1 of the reset period RP1, a setdown signal NR that gradually falls to a negative voltage−Ve is applied to the scan electrode, so that excessive wall charges unnecessary for an address discharge are erased from the discharge cells. A positive voltage is applied to the sustain electrode Z in synchronization with the setdown signal.

In the address period AP, a scan pulse −SCNP falling from a scan bias voltage Vyb to a negative scan voltage −Vy is sequentially applied to the scan electrode Y, and at the same time, a positive data pulse DP is applied to the address electrode X. At this time, a positive bias voltage is sustained to the sustain electrode Z. Accordingly, during the address period AP, the address discharge is generated due to a voltage difference between the scan pulse −SCNP and the data pulse DP, so that a discharge cell is selected.

Thereafter, in the sustain period SP, a sustain pulse SUSP having a positive sustain voltage Vs is alternately applied to the scan electrode Y and the sustain electrode Z, so that a sustain discharge is generated and light is displayed. In other words, the amount of light emitted is increased as the number of the sustain pulse SUSP supplied during the sustain period SP increases. Accordingly, luminance can be improved.

The present invention can be applied to a discharge cell including electrodes arranged in a long gap structure, and a plasma display device equipped with the discharge cell.

The long gap refers to one of a distance the transparent electrodes ITO constituting the scan electrode Y and the sustain electrode Z, and a distance between the metal electrodes, which is a smaller one. It is meant that the distance is 90 μm. Further, when the distance is 500 μm, it can be used for display devices.

Furthermore, when the distance is 200 μm or less, there is almost no possibility that an opposite discharge may occur between the scan electrode Y and the address electrode X, but a surface discharge is mainly generated between the scan electrode Y and the sustain electrode Z during the sustain period, thus displaying images. Accordingly, the long gap according to an embodiment of the present invention can be set in the range of 90 to 200 μm.

Figure 3:
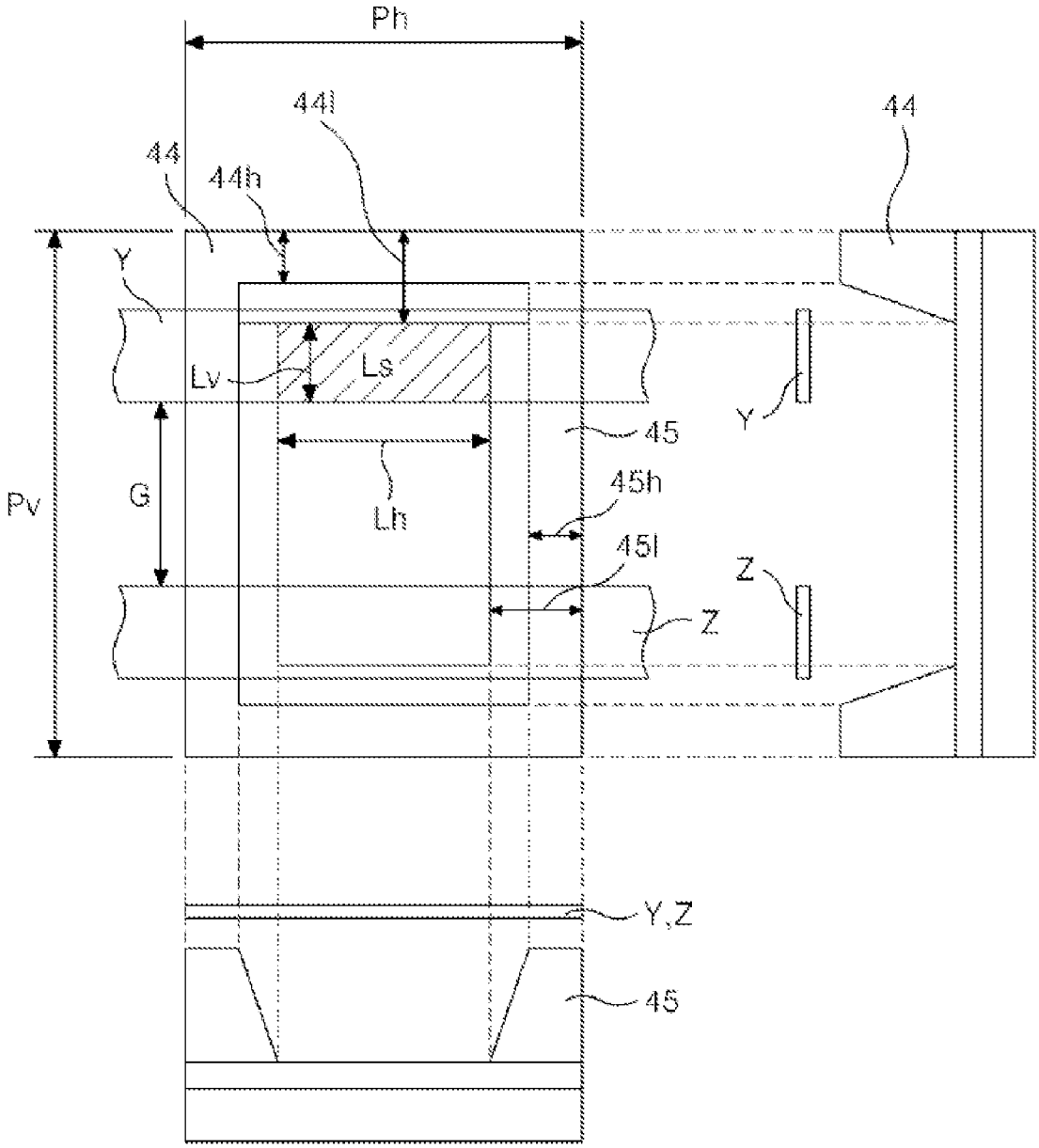
FIG. 3 is a view illustrating a scan electrode and a sustain electrode having top/bottom widths of a close type barrier rib and a long gap.

A discharge cell equipped with the electrodes of the long gap structure illustrated in FIG. 3 is partitioned by close type barrier ribs, and it includes the first barrier ribs 44, and the second barrier ribs 45 crossing the first barrier ribs 44.

A top width and a bottom width of the first barrier rib 44 and the second barrier rib 45 are designed so that a slashed valid overlap area Ls and a valid discharge space are expanded. A valid overlap area according to an embodiment of the present invention is a region overlapped with the scan electrode Y and the rear substrate exposed within the discharge space without being overlapped with the first barrier ribs 44 and the second barrier ribs 45. More particularly, the valid overlap area refers to the remaining regions of the rear substrate other than regions in which the first barrier ribs and the second barrier ribs are formed, and a region overlapped with the scan electrode Y.

The relationship between a top width and a bottom width of the first barrier rib according to an embodiment of the present invention is described below.

(1) 0<a bottom width 44*l* of the first barrier rib−a top width 44*h* of the first barrier rib<80 μm (more preferably, 0<the bottom width 44*l* of the first barrier rib −the top width 44*h* of the first barrier rib<60 μm (2) 1<the bottom width 44*l* of the first barrier rib/the top width 44*h* of the first barrier rib<1.4

(more particularly, where 1<the bottom width 44*l* of the first barrier rib/the top width 44*h* of the first barrier rib<1.3, jitter can be decreased, discharge voltage can be lowered, and luminance can be improved).

Furthermore, the relationship between a top width and a bottom width of the second barrier rib according to an embodiment of the present invention is described below.

(3)0<a bottom width 45*l* of the second barrier rib−a top width 45*h* of the second barrier rib<50 μm (more particularly, 0<the bottom width 45*l* of the second barrier rib−the top width 45*h* of the second barrier rib<30 μm).

(4) 1<the bottom width 45*l* of the second barrier rib/the top width 45*h* of the second barrier rib<1.8

(more particularly, where 1<the bottom width 45*l* of the second barrier rib/the top width 45*h* of the second barrier rib<1.5, jitter can be decreased, discharge voltage can be lowered, and luminance can be improved).

Furthermore, the relationship between a width Lh of the valid overlap area and the second pitch Pv of the discharge cell is described below.

(5) 0.63<the width Lh of the valid overlap area/the first pitch Ph of the discharge cell<1

(more particularly, 0.70<the width Lh of the valid overlap area/ the first pitch Ph of the discharge cell<1).

Furthermore, the relationship between a length Lv of the valid overlap area and the second pitch Ph of the discharge cell is described below.

(6) 0.24<the length Lv of the valid overlap area/the second pitch Pv of the discharge cell<1

(more particularly, where 0.26<the length Lv of the valid overlap area/the second pitch Pv of the discharge cell<1, jitter can be decreased, discharge voltage can be lowered, and luminance can be improved).

Further, the ration between the valid overlap area and the discharge cell area is as follows.

(7) The valid overlap area Ls/the discharge cell area>0.15

(more particularly, where the valid overlap area Ls/the cell area >0.18, jitter can be decreased, discharge voltage can be lowered, and luminance can be improved).

The relationship between top/bottom widths of a barrier rib, which fulfills conditions, is described below with reference to FIG. 4. In this case, it is assumed that the discharge cell is a discharge cell constituting a 42-inch XGA-grade panel. It can be varied depending on a panel size or a resolution level.

In a discharge cell in which a scan electrode and a sustain electrode are arranged in a long gap structure with them being spaced apart from each other at a distance of 90 μm or more, in a first embodiment, the first barrier rib has the top width 44*h* of 180 μm and the bottom width 44*l* of 260 μm, and the second barrier rib has the top width 45*h* of 60 μm and the bottom width 45*l* of 110 μm.

When the top/bottom widths of the barrier rib have the above values, the width Lh of the slashed valid overlap area is 190 μm and the length Lv of the slashed valid overlap area is 165 μm. Thus, the area (overlap area 1) of the valid overlap area becomes 190 μm×165 μm.

In a similar way, in a second embodiment, the first barrier rib has the top width 44*h* of 180 μm and the bottom width 44*l* of 240 μm, and the second barrier rib has the top width 45*h* of 60 μm and the bottom width 45*l* of 90 μm.

When the top/bottom widths of the barrier rib have the above values, the width Lh of the slashed valid overlap area is 210 μm and the length Lv of the slashed valid overlap area is 175 μm. Thus, the area (overlap area 2) of the valid overlap area becomes 210 μm×175 μm.

Figure 4:
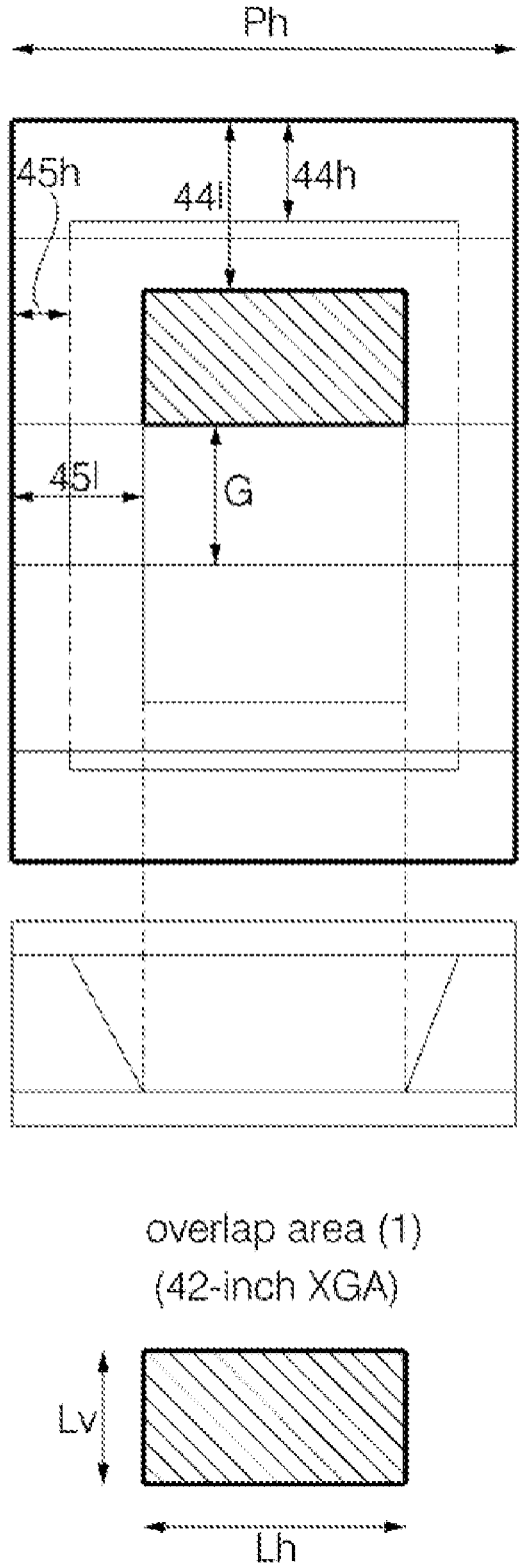
FIG. 4 is a view illustrating top/bottom widths of the close type barrier rib and the value of a valid overlap area.

It is has been described that the discharge cell illustrated in FIG. 4 has the first pitch Ph of 300 μm. However, the discharge cell may have a different the first pitch depending on a panel size, a picture level, a manufacturing model and/or the like. Further, discharge cells constituting the same panel may have different pitches depending on R, G and B color temperatures.

A width ratio and a pitch ratio in the top widths 44*h* and 45*h*, the bottom widths 44*l* and 45*l*, and the area Ls of the valid overlap area of the barrier ribs, and the area of the valid overlap area may be varied in at least one discharge cell that emits a different color of light.

For example, at least one of the top widths 44*h* and 45*h*, the bottom widths 44*l* and 45*l*, the pitches Ph and Pv, and the valid overlap area Ls of the first and the second barrier ribs can be the greatest in the B discharge cell, and is greater in the G discharge cell than in the R discharge cell or the same both in the G discharge cell and the R discharge cell.

Meanwhile, in conventional 42-inch XGA discharge cells in which top/bottom widths of barrier ribs are not optimized, the area of the valid overlap area is in general 150 μm×70 μm. Thus, the plasma display panel according to an embodiment of the present invention can reduce jitter and discharge voltages, and can enhance luminance.

The advantages of the present invention are described below with reference to FIGS. 5 and 6.

Figure 5:
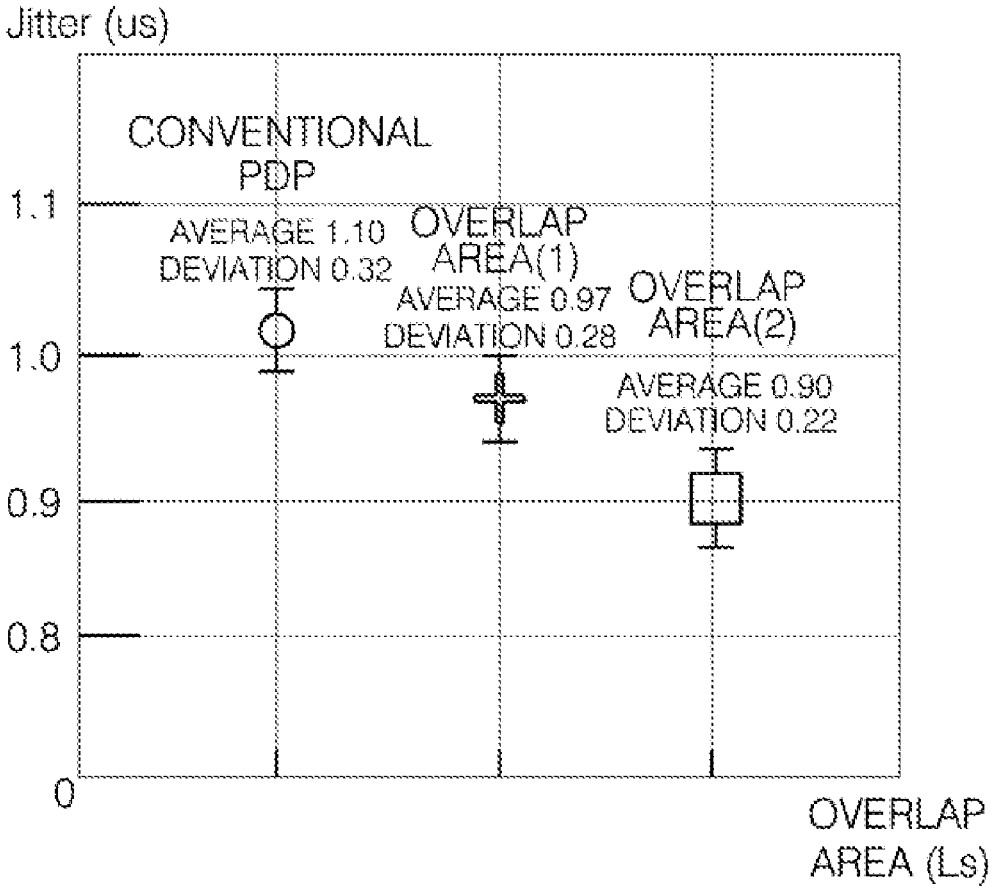
FIG. 5 is a graph illustrating a jitter characteristic of a plasma display panel according to an embodiment of the present invention.

From FIG. 5, it can be seen that a jitter characteristic is improved as the area of the valid overlap area reduces. It can also be seen that in the case where the barrier ribs having the values of the top/bottom widths shown in FIG. 4 are formed, the valid overlap area Ls increases and jitter decreases from 1.1 to 0.9, compared with a conventional panel.

Figure 6:
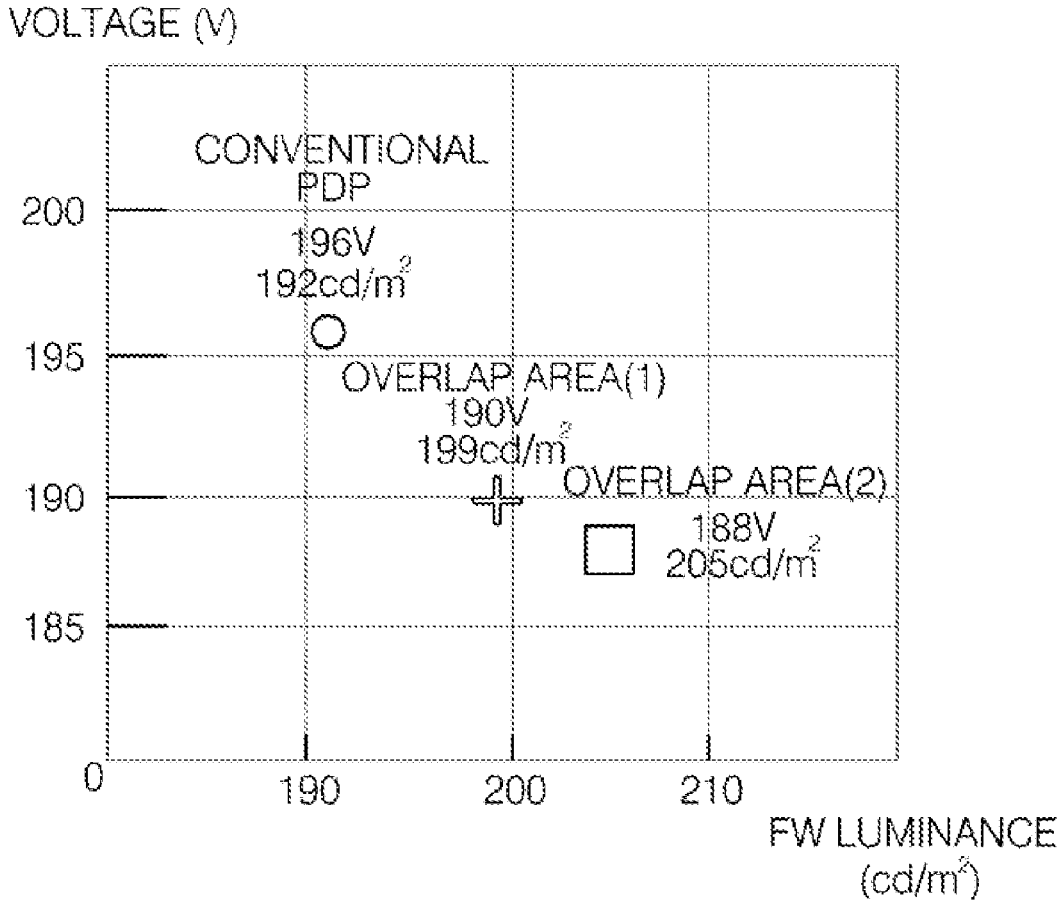
FIG. 6 is a graph illustrating discharge voltage of a plasma display panel according to an embodiment of the present invention.

An effect in which a discharge voltage is lowered can also be confirmed through FIG. 6. From FIG. 6, it can be seen that in the case where the barrier ribs having the values of the top/bottom widths shown in FIG. 4 are formed, a discharge voltage drops from 196 to 188 and luminance rises from 192 to 205, compared with a conventional panel.

Figure 7:
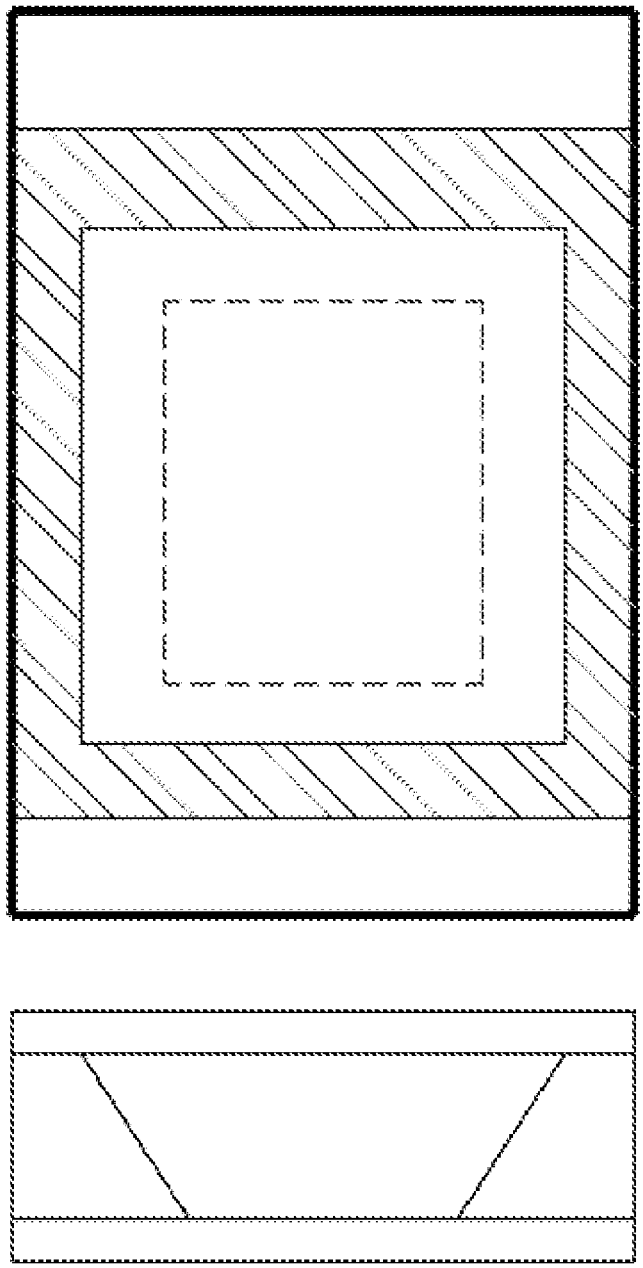
FIGS. 7 and 8 are views illustrating a discharge cell of the first barrier rib channel type.
Figure 8:
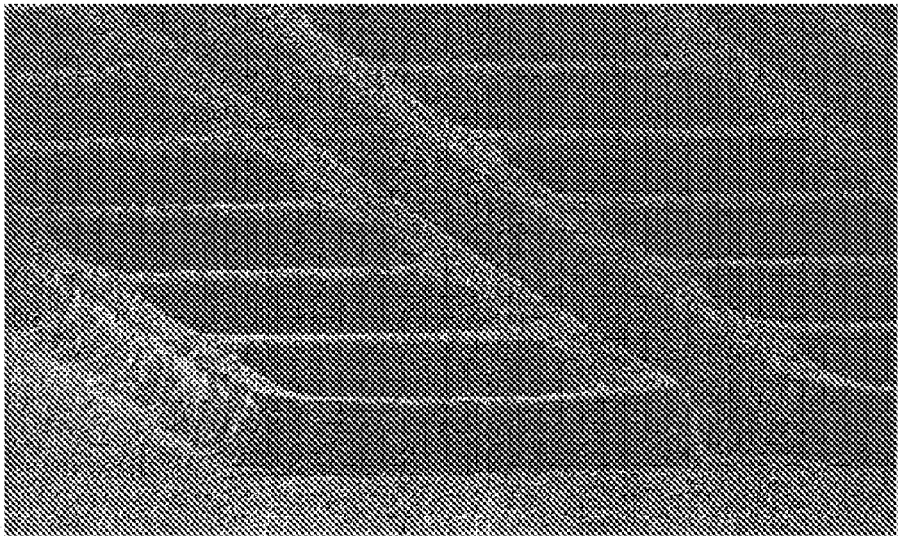
Figure 9:
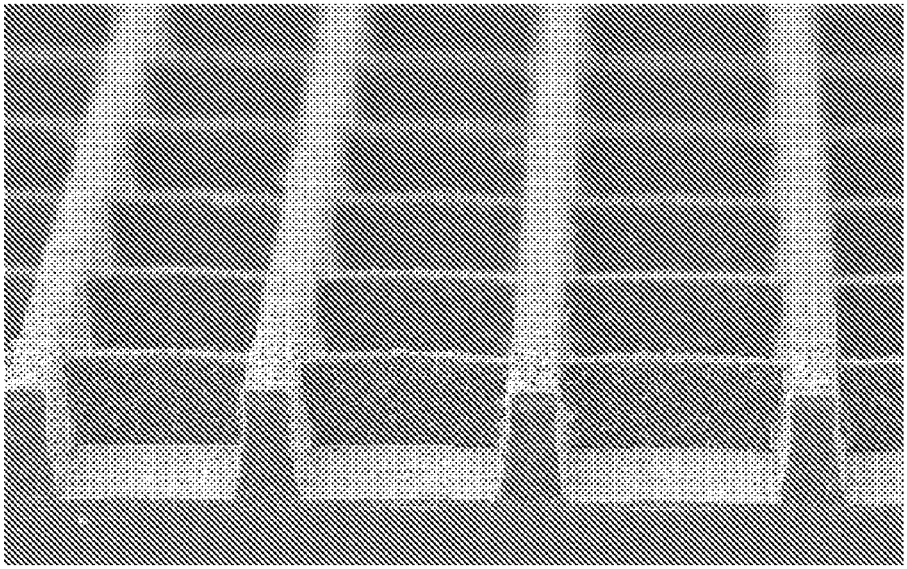
FIG. 9 illustrates a discharge cell having differential type barrier ribs.

The first embodiment in which the barrier ribs partitioning the discharge cells are a close type has been described above. However, the barrier ribs can include a channel type barrier rib in which grooves are formed in the first barrier ribs or the second barrier ribs, as illustrated in FIGS. 7 and 8, and a differential type barrier rib in which the height of barrier ribs in a second direction are lower than that of barrier ribs in a first direction in order to secure a gas exhaust path, as illustrated in FIG. 9.

Figure 10:
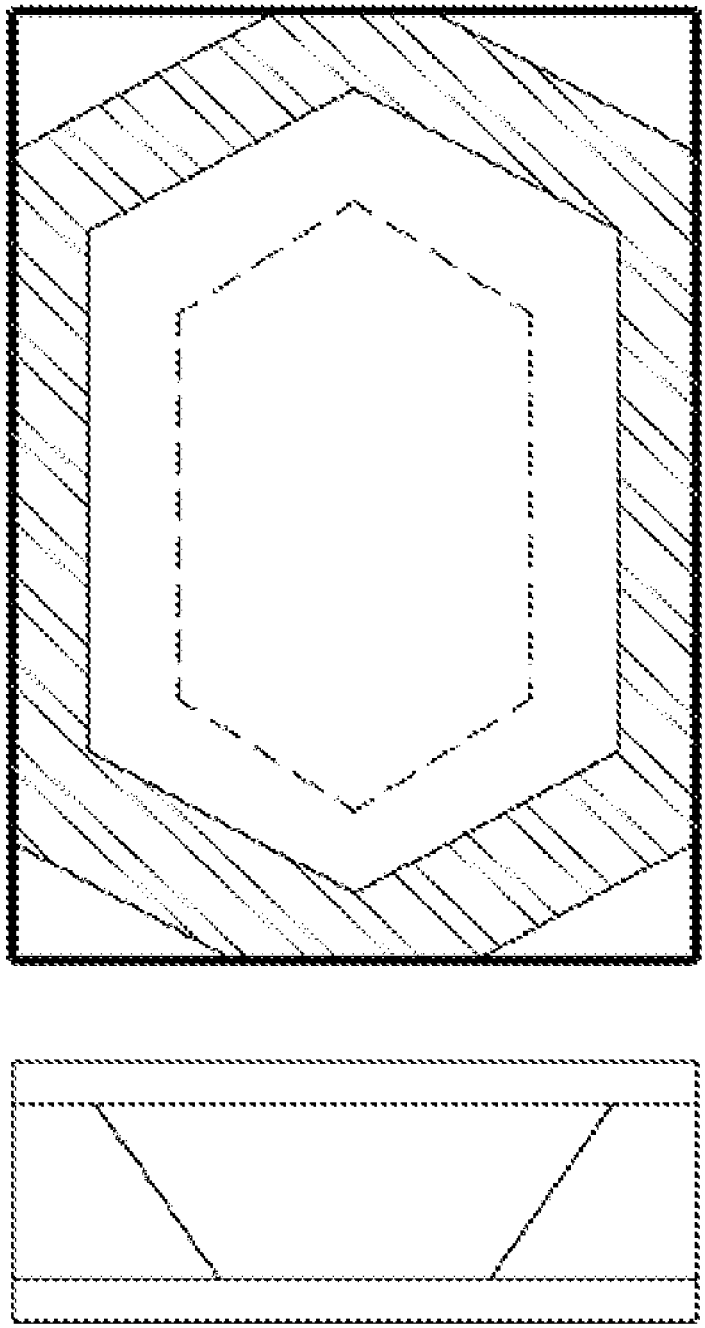
FIG. 10 illustrates a discharge cell having a beehive type barrier rib.
Figure 11:
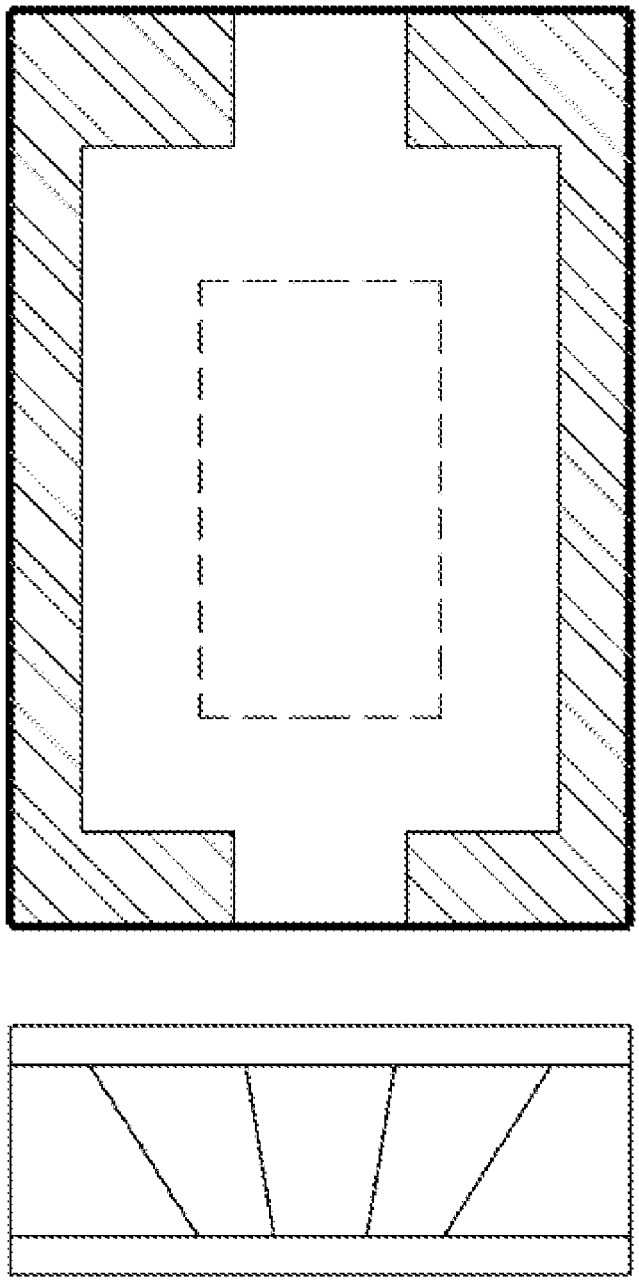
FIGS. 11 and 12 illustrate a discharge cell having fishbone type barrier ribs.
Figure 12:
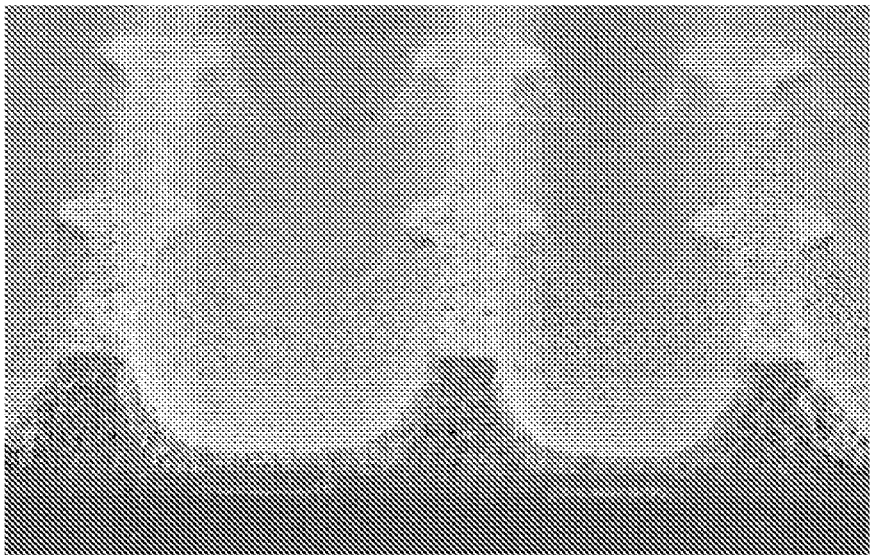

Furthermore, a discharge cell can have barrier ribs of a close type so that it is partitioned by a beehive shape as illustrated in FIG. 10. Alternatively, as illustrated in FIGS. 11 and 12, a discharge cell can have projections formed on the second barrier rib at a predetermined distance, and can have a fishbone shape in which between-the projections becomes exhaust paths between neighboring discharge cells.

Figure 13:
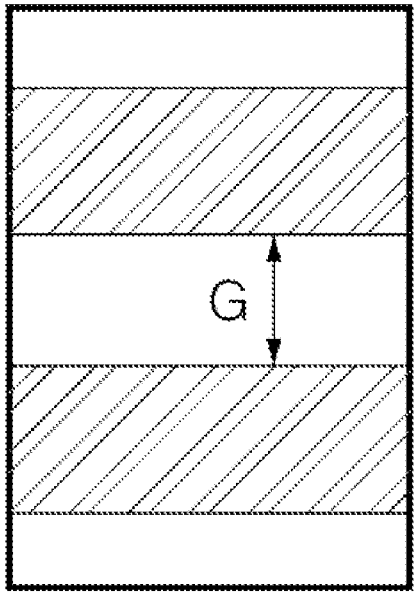
FIG. 13 is a view illustrating a transparent electrode of a stripe structure.
Figure 14:
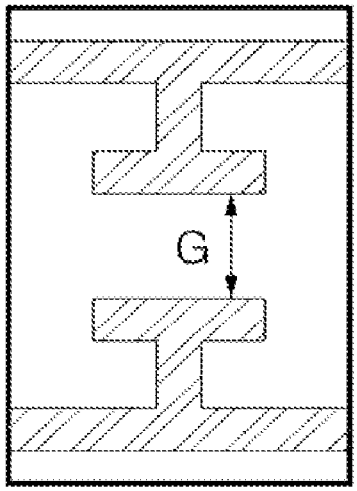
FIG. 14 is a view illustrating a transparent electrode of a blank structure.

Further, the scan electrode or the sustain electrode of the present invention can have a stripe structure and can be opposite to each other while forming a long gap, as in a first embodiment of FIG. 13, but can have a patterned blank structure in which a portion of the region of the transparent electrode is removed in order to secure the aperture ratio in the stripe form, as illustrated in FIG. 14.

Figure 15:
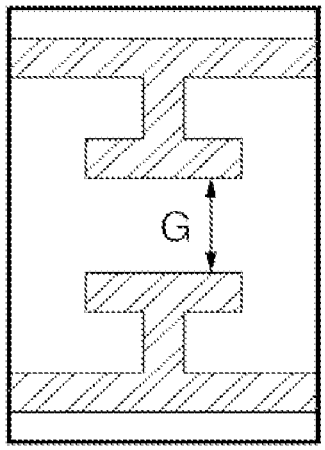
FIG. 15 is a view illustrating a transparent electrode of a T-shaped structure.
Figure 16:
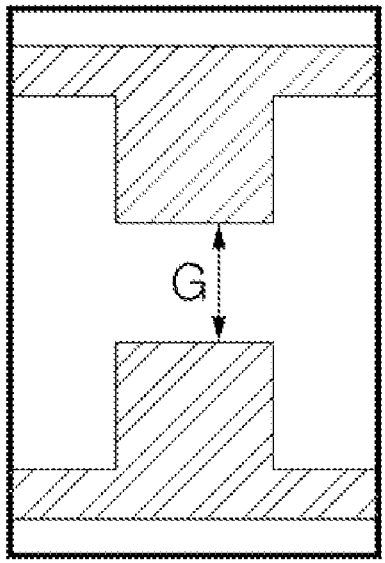
FIG. 16 is a view illustrating a transparent electrode of a projection structure.
Figure 17:
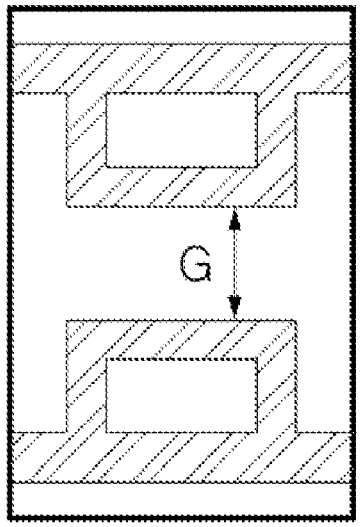
FIG. 17 is a view illustrating a transparent electrode of a projection type blank structure.

Furthermore, projections can be projected toward a discharge space in a stripe form, as illustrated in FIG. 15, the projections of the electrode can be patterned in a T shape, as illustrated in FIG. 16. Alternatively, the scan electrode or the sustain electrode can have a patterned structure in which an internal region of the projections of the electrode is removed in order to secure the aperture ratio, as illustrated in FIG. 17.

The variety of embodiments of the barrier ribs and embodiments of the electrodes are not limited to the illustrated drawings, and the effects of the present invention can be accomplished if the scan electrode and the sustain electrode form the long gap, and the top and bottom widths of the barrier ribs fulfill the numerical range presented by the present invention in order to secure the valid overlap area. While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device comprising a discharge cell including a scan electrode and a sustain electrode formed on a front substrate, and an address electrode formed on a rear substrate, the discharge cell being separated from neighboring discharge cells by means of a first barrier rib and a second barrier rib crossing the first barrier rib formed on the rear substrate, wherein a distance between the scan electrode and the sustain electrode is set in a range of 90 to 200 μm, the first barrier rib has a bottom width wider than a top width, a difference between the bottom width and the top width of the first barrier rib is set in a range of 80 μm or less, wherein a value obtained by dividing a first length of an overlapping area of the scan electrode and an area of the rear substrate other than a region in which the barrier ribs are formed within the discharge cell by a first pitch of the discharge cell is greater than 0.63 and smaller than 1.

2. The plasma display device of claim 1, wherein the bottom width of the first barrier rib is 1 times greater than to 1.4 times smaller than the top width of the first barrier rib.

3. The plasma display device of claim 1, wherein the discharge cell is partitioned by one of a close type barrier rib in which four directions are partitioned by the first barrier rib and the second barrier rib, a channel type barrier rib in which grooves are formed in the first barrier rib or the second barrier rib, and a differential type barrier rib in which a height of the first barrier rib is different from that of the second barrier rib.

4. The plasma display device of claim 1, wherein:

at least one of the scan electrode and the sustain electrode comprise a transparent electrode, and a metal electrode partially overlapped with the transparent electrode, and the distance between the scan electrode and the sustain electrode corresponds to one of a distance between adjacent of transparent electrodes and a distance between adjacent of metal electrodes, wherein the distance between the adjacent transparent electrodes is less than the distance between the adjacent metal electrodes.

5. The plasma display device of claim 4, wherein the metal electrode is overlapped with the transparent electrode within a range of 0.4 to 0.5 times greater than a width of the transparent electrode.

6. The plasma display device of claim 1, wherein:

the second barrier rib has a bottom width wider than a top width, and a distance between the bottom width and the top width of the second barrier rib is set in the range of 50 μm or less.

7. The plasma display device of claim 1, wherein:

the second barrier rib has a bottom width wider than a top width, and a value in which the bottom width is divided by the top width is greater than 1 and smaller than 1.8.

8. The plasma display device of claim 1, wherein a value obtained by dividing an overlapping area of the scan electrode and an area of the rear substrate other than a region in which the barrier ribs are formed within the discharge cell by an area of the discharge cell is greater than 0.15 and smaller than 1.

9. The plasma display device of claim 1, wherein a value obtained by dividing a second length of an overlapping area of the scan electrode and an area of the rear substrate other than a region in which the barrier ribs are formed within the discharge cell by a second pitch of the discharge cell is greater than 0.24 and smaller than 1.

10. A plasma display device comprising a discharge cell including a scan electrode, a sustain electrode and an address electrode, the discharge cell being separated from neighboring discharge cells by means of a first barrier rib and a second barrier rib crossing the first barrier rib formed on a rear substrate, wherein a distance between the scan electrode and the sustain electrode is set in a range of 90 to 200 μm, the second barrier rib has a bottom width wider than a top width, a difference between the bottom width and the top width of the second barrier rib is set in a range of 50 μm or less, and wherein a value in which an overlapping area of the scan electrode and an area of the rear substrate other than a region in which the barrier ribs are formed within the discharge cell is divided by an area of the discharge cell is greater than 0.15 and smaller than 1.

11. The plasma display device of claim 10, wherein a value in which the bottom width of the second barrier rib is divided by the top width of the second barrier rib is greater than 1 and smaller than 1.8.

12. The plasma display device of claim 10, wherein the discharge cell is partitioned by one of a close type barrier rib in which four directions are partitioned by the first barrier rib and the second barrier rib, a channel type barrier rib in which grooves are formed in the first barrier rib or the second barrier rib, and a differential type barrier rib in which a height of the first barrier rib is different from that of the second barrier rib.

13. The plasma display device of claim 10, wherein:

a difference between a bottom width and a top width of the first barrier rib is smaller than 80 μm, and the bottom width of the first barrier rib is 1 times greater than to 1.4 times smaller than the top width of the first barrier rib.

14. A plasma display device comprising a discharge cell including a scan electrode, a sustain electrode and an address electrode, the discharge cell being separated from neighboring discharge cells by means of a first barrier rib and a second barrier rib crossing the first barrier rib formed on a rear substrate, wherein a distance between the scan electrode and the sustain electrode is set in a range of 90 to 200 μm, and at least one of a first condition in which a value where a first length of an overlapping area where the scan electrode and an area of the rear substrate other than a region in which the barrier ribs formed are overlapped is divided by a first pitch of the discharge cell is greater than 0.63 and smaller than 1, a second condition in which a value where a second length of the overlapping area is divided by a second pitch of the discharge cell is greater than 0.24 and smaller than 1, and a third condition in which a value where an area of the overlapping area is divided by an area of the discharge cell is greater than 0.15 and smaller than 1 is fulfilled.

15. The plasma display device of claim 14, wherein:

a difference between a bottom width and a top width of the first barrier rib is smaller than 80 μm, and the bottom width of the first barrier rib is 1 times greater than to 1.4 times smaller than the top width of the first barrier rib.

16. The plasma display device of claim 14, wherein:

a difference between a bottom width and a top width of the second barrier rib is smaller than 50 μm, and the bottom width of the second barrier rib is 1 times greater than to 1.8 times smaller than the top width of the first barrier rib.

17. The plasma display device of claim 14, wherein the discharge cell is partitioned by one of a close type barrier rib in which four directions are partitioned by the first barrier rib and the second barrier rib, a channel type barrier rib in which grooves are formed in the first barrier rib or the second barrier rib, and a differential type barrier rib in which a height of the first barrier rib is different from that of the second barrier rib.

18. The plasma display device of claim 14, wherein at least one of the first condition, the second condition and the third condition is different in at least one of a R discharge cell, a G discharge cell and a B discharge cell.

19. The plasma display device of claim 1, wherein:

at least one of the scan electrode or the sustain electrode comprise a transparent electrode, and a metal electrode partially overlapped with the transparent electrode, and the distance between the scan electrode and the sustain electrode corresponds to a distance between adjacent of transparent electrodes.

20. The plasma display device of claim 1, wherein:

at least one of the scan electrode or the sustain electrode comprise a transparent electrode, and a metal electrode partially overlapped with the transparent electrode, and the distance between the scan electrode and the sustain electrode corresponds to distance between adjacent of metal electrodes.

21. The plasma display device of claim 20, wherein:

the distance between the adjacent transparent electrodes is less than the distance between the adjacent metal electrodes, and the metal electrode comprises a bus electrode.

* * * * *